US011511908B2

(12) United States Patent
Prakken et al.

(10) Patent No.: US 11,511,908 B2
(45) Date of Patent: Nov. 29, 2022

(54) PACKING BOX CONVERTABLE FROM A SHIPPING CONFIGURATION TO A DISPLAY CONFIGURATION

(71) Applicant: BLUEPRINT HOLDING B.V., Woerden (NL)

(72) Inventors: Nicolaas Martin Prakken, Chester, VA (US); Wilhelmus Maria Nijssen, Uitgeest (NL); Hendrik Frederik Mets, Nieuw-Vennep (NL)

(73) Assignee: BLUEPRINT HOLDING B.V., Woerden (NL)

( * ) Notice: Subject to any disclaimer, the term of this patent is extended or adjusted under 35 U.S.C. 154(b) by 0 days.

(21) Appl. No.: 16/610,092

(22) PCT Filed: May 2, 2018

(86) PCT No.: PCT/NL2018/050289

§ 371 (c)(1),
(2) Date: Nov. 1, 2019

(87) PCT Pub. No.: WO2018/203748

PCT Pub. Date: Nov. 8, 2018

(65) Prior Publication Data

US 2020/0079549 A1 Mar. 12, 2020

(30) Foreign Application Priority Data

May 3, 2017 (NL) ..... 2018841

(51) Int. Cl.
*B65D 5/54* (2006.01)
*B65B 5/02* (2006.01)
(Continued)

(52) U.S. Cl.
CPC ..... *B65D 5/5445* (2013.01); *B65B 5/024* (2013.01); *B65B 7/20* (2013.01); *B65D 5/16* (2013.01); *B65D 5/4608* (2013.01); *B65D 5/542* (2013.01)

(58) Field of Classification Search
CPC .... B65D 5/5445; B65D 5/4608; B65D 5/542; B65D 5/16; B65B 5/024; B65B 7/20
(Continued)

(56) References Cited

U.S. PATENT DOCUMENTS 3,633,815 A * 1/1972 Rosenburg, Jr. ..... B65D 5/6626 229/110
3,917,158 A * 11/1975 Dorofachuk ..... B65D 5/0227 229/241

(Continued)

FOREIGN PATENT DOCUMENTS

EP 3 061 697 A1 8/2016

OTHER PUBLICATIONS

International Search Report and Written Opinion, dated Jun. 29, 2018, from corresponding PCT application No. PCT/NL2018/050289.

*Primary Examiner* — Rafael A Ortiz
*Assistant Examiner* — Sanjidul Islam
(74) *Attorney, Agent, or Firm* — Nixon & Vanderhye

(57) ABSTRACT

A packing box includes a separation line in a shipping configuration, the separation line allowing separating a separation part from the packing box to leave a display part in a display configuration. First to last panels are sequentially interconnected, and flaps are connected to the panels. The flaps cooperatively define further sides of the packing box in the shipping configuration, and adjacent flaps connected to adjacent mutually connected panels are attached to one another. The separation line extends through a single panel from a first end associated with a position between adjacent first separation and display flaps to a second end associated with a position between adjacent second separation and display flaps, the separation flaps being associated with the separation part and the display flaps being associated with the display part. The separation flaps, and the adjacent display flaps are attached to one another, respectively, in a releasable manner.

24 Claims, 9 Drawing Sheets

(51) Int. Cl.
*B65B 7/20* (2006.01)
*B65D 5/468* (2006.01)
*B65D 5/16* (2006.01)

(58) Field of Classification Search
USPC ..... 229/235, 242, 340; 206/738, 739
See application file for complete search history.

(56) References Cited

U.S. PATENT DOCUMENTS

| | | | | |
|---|---|---|---|---|
| 6,155,480 | A * | 12/2000 | Botsford | B65D 5/725 229/242 |
| 6,435,351 | B1 * | 8/2002 | Gibb | B65D 5/542 206/774 |
| 6,457,637 | B1 | 10/2002 | Fritz et al. | |
| 7,717,324 | B2 * | 5/2010 | Keefe, Jr. | B65D 5/548 206/736 |
| 8,959,877 | B2 * | 2/2015 | Maki | B65D 5/542 493/63 |
| 2004/0163994 | A1 * | 8/2004 | Gardner | B65D 5/541 206/736 |
| 2009/0014352 | A1 * | 1/2009 | Foden | B65D 5/5445 206/746 |
| 2016/0304236 | A1 * | 10/2016 | Nishikawa | B65D 5/64 |

* cited by examiner

PACKING BOX CONVERTABLE FROM A SHIPPING CONFIGURATION TO A DISPLAY CONFIGURATION

FIELD OF THE INVENTION

The invention relates to a packing box for shipping and displaying articles packed in the packing box, the packing box comprising a separation line in a shipping configuration of the packing box, the separation line allowing to separate a separation part from the packing box to leave a display part in a display configuration of the packing box; panels sequentially connected to one another from a first panel to a last panel to define a circumference and sides of the packing box in the shipping configuration; and flaps connected to the panels at respective opposing first and second flap side flanks of the panels, the flaps in cooperation with one another defining further sides of the packing box in the shipping configuration, and adjacent flaps that are connected to adjacent mutually connected panels being attached to one another. The invention further relates to a blank for assembling such a packing box, a packing method for packing articles into the packing box in the shipping configuration, and to a display preparation method for converting the packing box from the shipping configuration to the display configuration.

BACKGROUND OF THE INVENTION

Packing boxes are widely applied for holding, storing and transporting articles. The articles, or products, are produced at a manufacturing site, where they generally are packed into the packing box in dedicated packing lines. Subsequently, they are usually shipped to a location, such as a retail store, where the articles will be distributed or sold. In between packing and shipping, and in between shipping and distribution the packing boxes with articles may be stored and/or change from one transportation means to another. The packing boxes should therefore be well suited for packing, transportation and handling.

It has become customary to display the packing box or part of the packing box with articles in, for instance, a super market. Customers can take the articles directly from the packing box. Packing boxes have been proposed specifically for this purpose. However, they usually appear quite damaged when put up for display with the products.

Further, packing boxes that are designed to allow to put up products for display in the packing box are not well suited for packing, storing and transportation of products or articles in the packing box. Therefore, there is a need for an improved packing box.

SUMMARY OF THE INVENTION

It is an objective of the invention to provide a packing box that allows to put up articles for display in a part of the packing box.

It is another or alternative objective of the invention to provide a packing box that can efficiently be packed with articles.

It is yet another or alternative objective of the invention to provide a packing box that is very well suited for storing and transporting articles.

It is yet another or alternative objective of the invention to provide a packing box that is well suited for stacking of multiple packing boxes.

At least one of the above objectives is achieved by a packing box for shipping and displaying articles packed in the packing box, the packing box comprising a separation line in a shipping configuration of the packing box, the separation line allowing to separate a separation part from the packing box in the shipping configuration to leave a display part in a display configuration of the packing box;

panels sequentially connected to one another from a first panel to a last panel to define a circumference and sides of the packing box in the shipping configuration; and flaps connected to the panels at respective opposing first and second flap side flanks of the panels, the flaps in cooperation with one another defining further sides of the packing box in the shipping configuration, and adjacent flaps that are connected to adjacent mutually connected panels being attached to one another, wherein the separation line extends from a first separation line end associated with a position between adjacent first separation and display flaps of the flaps, which are connected to respective first flap side flanks to a second separation line end associated with a position between adjacent second separation and display flaps of the flaps, which are connected to respective second flap side flanks, the first and second separation flaps being associated with the separation part and the first and second display flaps being associated with the display part, and wherein the first and second separation flaps, and the adjacent first and second display flaps are attached to one another, respectively, in a releasable manner, and wherein the separation line extends through a single panel.

The packing according to the invention is very well suited for packing and shipping articles, and allows stacking multiple packing boxes on top of one another. After shipping, the box can efficiently be converted from the shipping to the display configuration with a minimum number of actions.

In an embodiment the first and second separation flaps, and the adjacent first and second display flaps are attached to one another, respectively, in a releasable manner that allows attachment release of said respective adjacent first and second separation and display flaps while maintaining integrity of the flaps and panels to provide a very clean display configuration of the packing box.

In an embodiment the first and second separation flaps, and the adjacent first and second display flaps are attached to one another, respectively, in a releasable manner to allow attachment release of said respective adjacent first and second separation and display flaps through rotation of the panel connected to the first and second separation flaps with respect to the adjacent connected panel connected to the first and second display flaps around an intersection line of said respective panels connected to the first and second separation and display flaps. This allows converting the packing box to the display configuration with a single action of rotation of the separation part. First the releasable attachment of the respective flaps of separation and display parts will be released, after which the separation line can be separated by further rotation and pulling.

In an embodiment the first and second separation flaps, and the adjacent first and second display flaps are attached to one another, respectively, by a glue, optionally a releasable glue, allowing said respective adjacent first and second separation and display flaps to be separated with a force manually applied to the separation part. This provides for an efficient releasable attachment of the respective flaps, which can be easily released for providing the display configuration, while keeping the flaps well attached during shipping and storage. The amount of glue to be applied is determined by the adhesive properties of the glue, the amount of glue applied, the surface area on which the glue is applied, etcetera. A very well suited combination of such characteristics can be very well determined in practical circumstances for various applications to allow separation by a manually applied force, i.e a force applied by hand.

In an embodiment the first and second separation flaps, and the adjacent first and second display flaps are attached to one another, respectively, by a glue provided to glue areas of the first and second separation flaps and the adjacent first and second display flaps, and the glue areas of one or both of the first and second separation flaps and the adjacent first and second display flaps are surrounded by a perforation line. The perforation line around the glue areas allows separating the glue areas from the respective flaps for easy and efficient attachment release of the flaps.

In an embodiment the separation line extends through the panel connected to the first and second display flaps.

In an embodiment first sections of the separation line at the first and second separation line ends include a first angle of 30°-60°, optionally an angle of 40°-50°, with a respective associated flap side flank or a line parallel thereto. Such range for the first angle provides that the separation line easily and cleanly separates when applying an appropriate force.

In an embodiment second sections of the separation line following the respective first sections with respect to the separation line ends include a second angle with a line parallel to a respective associated flap side flank which is smaller than the first angle. This ensures that separation proceeds in a good manner after initial start of separation of the separation line.

In an embodiment a middle section of the separation line includes at least one of an opening and a fully cut-through part, which ensures that complete separation is easily achieved with least actions and force since separation action has only to be performed until the opening or cut-through part.

In an embodiment the first and second separation line ends are each at a respective flap side flank and/or at a side flank extending from a position between the first separation and display flaps and a position between the second separation and display flaps.

In an embodiment the first and second separation line ends are each in a respective corner of the panel connected to the first and second display flaps.

In an embodiment the separation line comprises a tear line, optionally a perforated tear line. A tear line, especially a perforated tear line can be efficiently made during manufacturing and allows easy separation.

In another aspect the invention provides for a blank for a packing box referred to above, the blank comprising panels sequentially connected to one another from a first panel to a last panel for defining a circumference and sides of the packing box in a shipping configuration;

flaps connected to the panels at respective opposing first and second flap side flanks of the panels, the flaps in cooperation with one another allowing to define further sides of the packing box in the shipping configuration, adjacent flaps that are connected to adjacent mutually connected panels being configured to allow attachment to one another; and a separation line allowing to separate a separation part from the packing box in the shipping configuration to leave a display part in a display configuration of the packing box, wherein the separation line extends from a first separation line end associated with a position between adjacent first separation and display flaps of the flaps, which are connected to respective first flap side flanks, to a second separation line end associated with a position between adjacent second separation and display flaps of the flaps, which are connected to respective second flap side flanks, the first and second separation flaps being associated with the separation part and the first and second display flaps being associated with the display part, wherein the separation line extends through a single panel.

In an embodiment the separation line extends through the panel connected to the first and second display flaps.

In an embodiment first sections of the separation line at the first and second separation line ends include a first angle of 30°-60°, optionally an angle of 40°-50°, with a respective associated flap side flank or a line parallel thereto.

In an embodiment second sections of the separation line following the respective first sections with respect to the separation line ends include a second angle with a line parallel to a respective associated flap side flank which is smaller than the first angle.

In an embodiment a middle section of the separation line includes at least one of an opening and a fully cut-through part.

In an embodiment the first and second separation line ends are each at a respective flap side flank and/or at a side flank extending from a position between the first separation and display flaps and a position between the second separation and display flaps.

In an embodiment the first and second separation line ends are each in a respective corner of the panel connected to the first and second display flaps.

In an embodiment glue areas of one or both of the first and second separation flaps and the adjacent first and second display flaps are surrounded by a perforation line.

In an embodiment the separation line comprises a tear line, optionally a perforated tear line.

In yet another aspect the invention provides for a packing method of packing articles into a packing box referred to above in the shipping configuration, the method comprising providing a blank comprising panels sequentially connected to one another from a first panel to a last panel for defining a circumference and sides of the packing box in a shipping configuration of the packing box;

flaps connected to the panels at respective opposing first and second flap side flanks of the panels, the flaps in cooperation with one another allowing to define further sides of the packing box in the shipping configuration, adjacent flaps that are connected to adjacent mutually connected panels being configured to allow attachment to one another; and a separation line allowing to separate a separation part from the packing box in the shipping configuration to leave a display part in a display configuration of the packing box, wherein the separation line extends through a single panel from a first separation line end associated with a position between adjacent first separation and display flaps of the flaps, which are connected to respective first flap side flanks, to a second separation line end associated with a position between adjacent second separation and display flaps of the flaps, which are connected to respective second flap side flanks, the first and second separation flaps being associated with the separation part and the first and second display flaps being associated with the display part;

partially assembling the packing box into the shipping configuration from the blank to allow articles to be packed inside the partially assembled packing box, which comprises attaching respective flaps to one another while leaving remaining respective flaps not attached to one another;

packing articles inside the partially assembled shipping configuration of the packing box; and finally assembling the packing box into the shipping configuration, which comprises attaching the remaining respective flaps to one another, wherein the first and second separation flaps, and the adjacent first and second display flaps are attached to one another, respectively, in a releasable manner.

In an embodiment the first and second separation flaps, and the adjacent first and second display flaps are attached to one another, respectively, in a releasable manner that allows attachment release of said respective adjacent first and second separation and display flaps while maintaining integrity of the flaps and panels.

In an embodiment the first and second separation flaps, and the adjacent first and second display flaps are attached to one another, respectively, in a releasable manner to allow attachment release of said respective adjacent first and second separation and display flaps through rotation of the panel connected to the first and second separation flaps with respect to the adjacent connected panel connected to the first and second display flaps around an intersection line of said respective panels connected to the first and second separation and display flaps.

In an embodiment the first and second separation flaps, and the adjacent first and second display flaps are attached to one another, respectively, by a glue, optionally a releasable glue, allowing said respective adjacent first and second separation and display flaps to be separated with a force manually applied to the separation part.

In an embodiment the first and second separation flaps, and the adjacent first and second display flaps are attached to one another, respectively, by a glue provided to glue areas of the first and second separation flaps and the adjacent first and second display flaps, and the glue areas of one or both of the first and second separation flaps and the adjacent first and second display flaps are surrounded by a perforation line.

In yet another aspect the invention provides for a display preparation method for converting a packing box according to any one of the preceding claims from the shipping configuration to the display configuration, the method comprising providing a packing box packed with articles in a shipping configuration, the packing box comprising a separation line in the shipping configuration of the packing box, the separation line allowing to separate a separation part from the packing box to leave a display part in a display configuration of the packing box;

panels sequentially connected to one another from a first panel to a last panel to define a circumference and sides of the packing box in the shipping configuration; and flaps connected to the panels at respective opposing first and second flap side flanks of the panels, the flaps in cooperation with one another defining further sides of the packing box in the shipping configuration, and adjacent flaps that are connected to adjacent mutually connected panels being attached to one another, wherein the separation line extends from a first separation line end associated with a position between adjacent first separation and display flaps of the flaps, which are connected to respective first flap side flanks, to a second separation line end associated with a position between adjacent second separation and display flaps of the flaps, which are connected to respective second flap side flanks, the first and second separation flaps being associated with the separation part and the first and second display flaps being associated with the display part, and wherein the first and second separation flaps, and the adjacent first and second display flaps are attached to one another, respectively, in a releasable manner releasing attachment of the first and second separation flaps, and the adjacent first and second display flaps, respectively; and separating the separation part from the display part by employing the separation line to obtain the packing box in the display configuration.

In an embodiment the method comprises releasing attachment of the first and second separation flaps, and the adjacent first and second display flaps, respectively, through rotation of the panel connected to the first and second separation flaps with respect to the adjacent connected panel connected to the first and second display flaps around an intersection line of said respective panels connected to the first and second separation and display flaps

BRIEF DESCRIPTION OF THE DRAWINGS

Further features and advantages of the invention will become apparent from the description of the invention by way of non-limiting and non-exclusive embodiments. These embodiments are not to be construed as limiting the scope of protection. The person skilled in the art will realize that other alternatives and equivalent embodiments of the invention can be conceived and reduced to practice without departing from the scope of the present invention. Embodiments of the invention will be described with reference to the accompanying drawings, in which like or same reference symbols denote like, same or corresponding parts, and in which.

DETAILED DESCRIPTION OF EMBODIMENTS

Figure 1A:
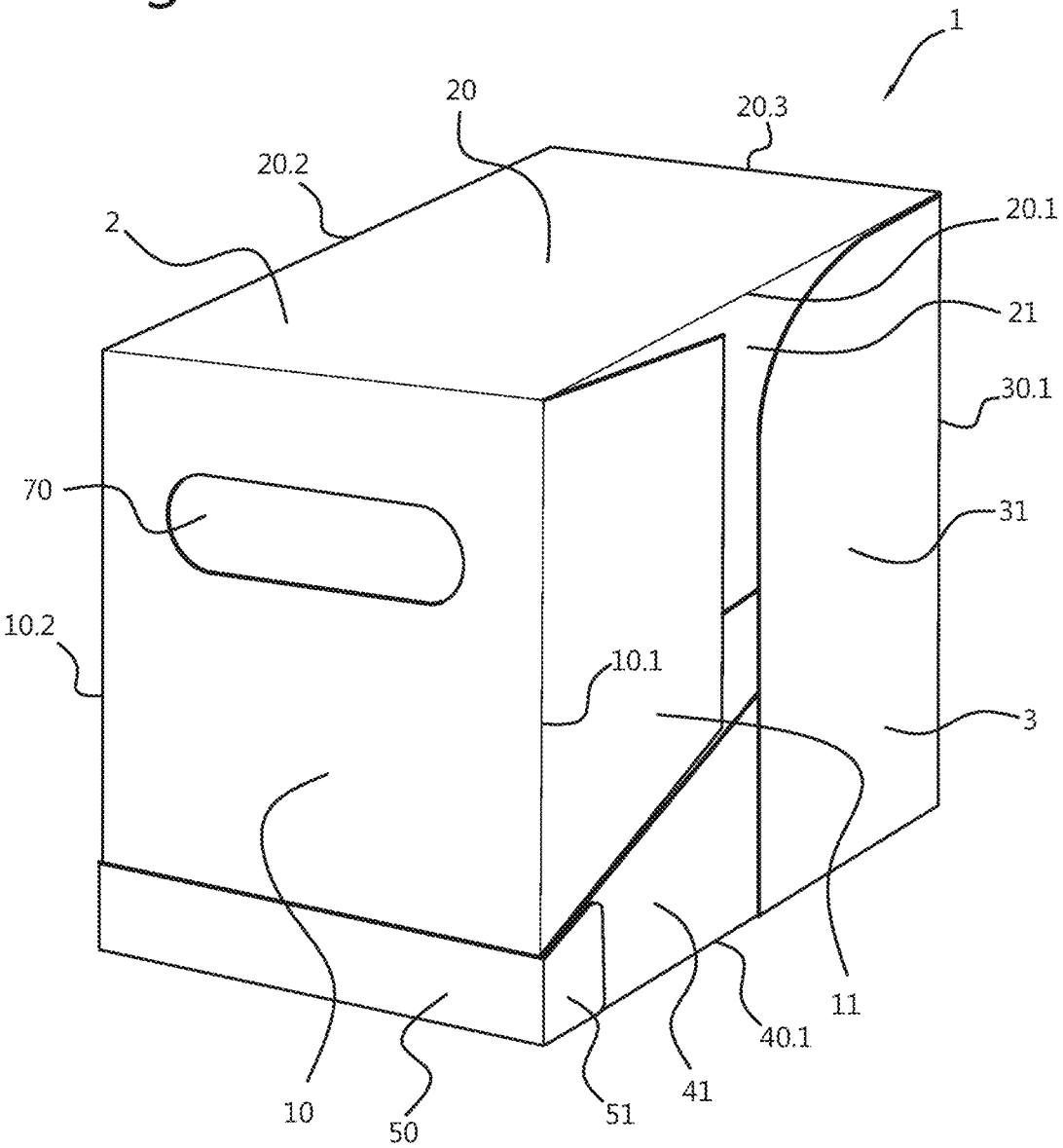
FIGS. 1A and 1B show a front perspective view and a rear perspective view, respectively, of an embodiment of a packing box according to the invention in shipping configuration.
Figure 1B:
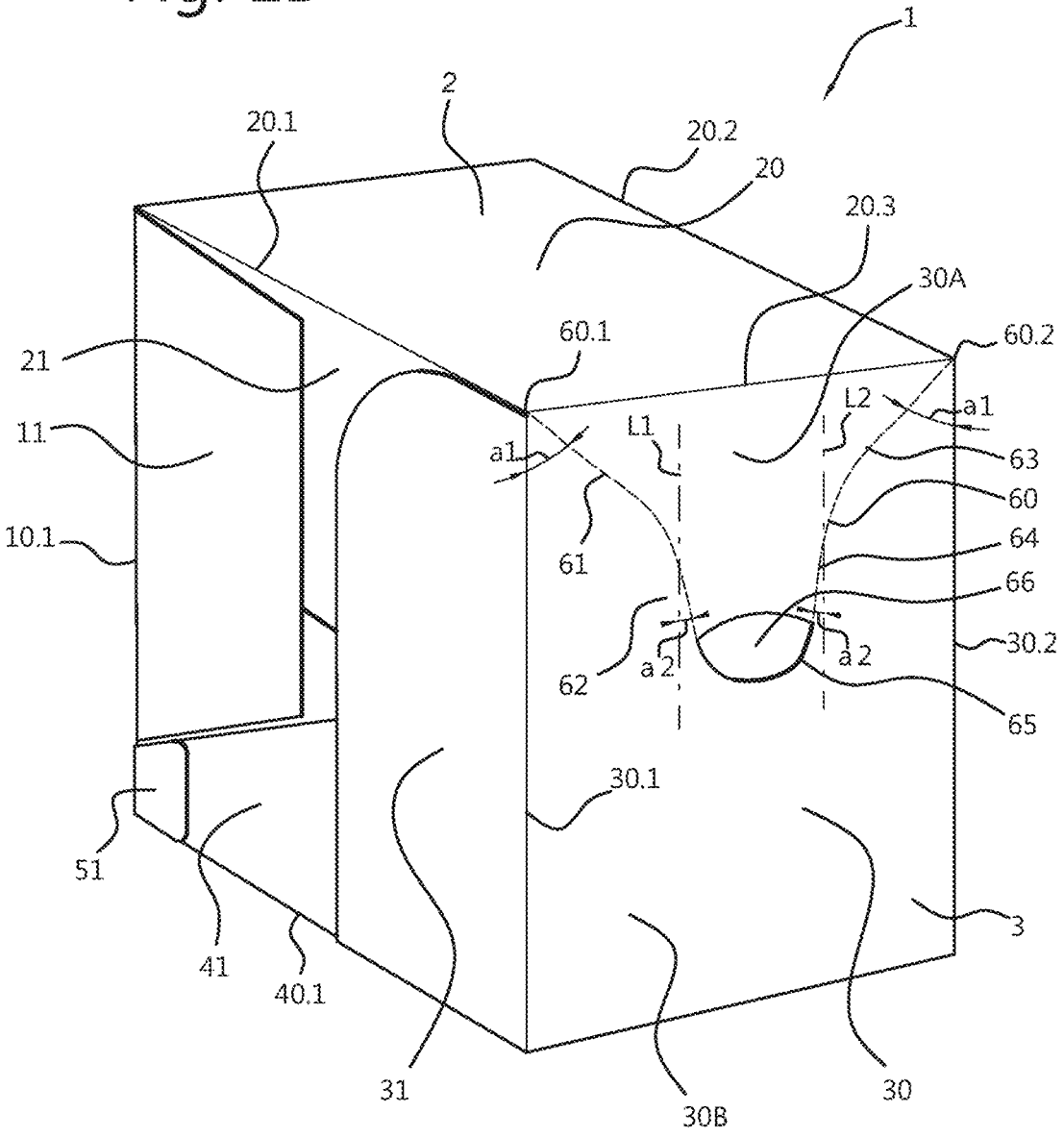
Figure 3:
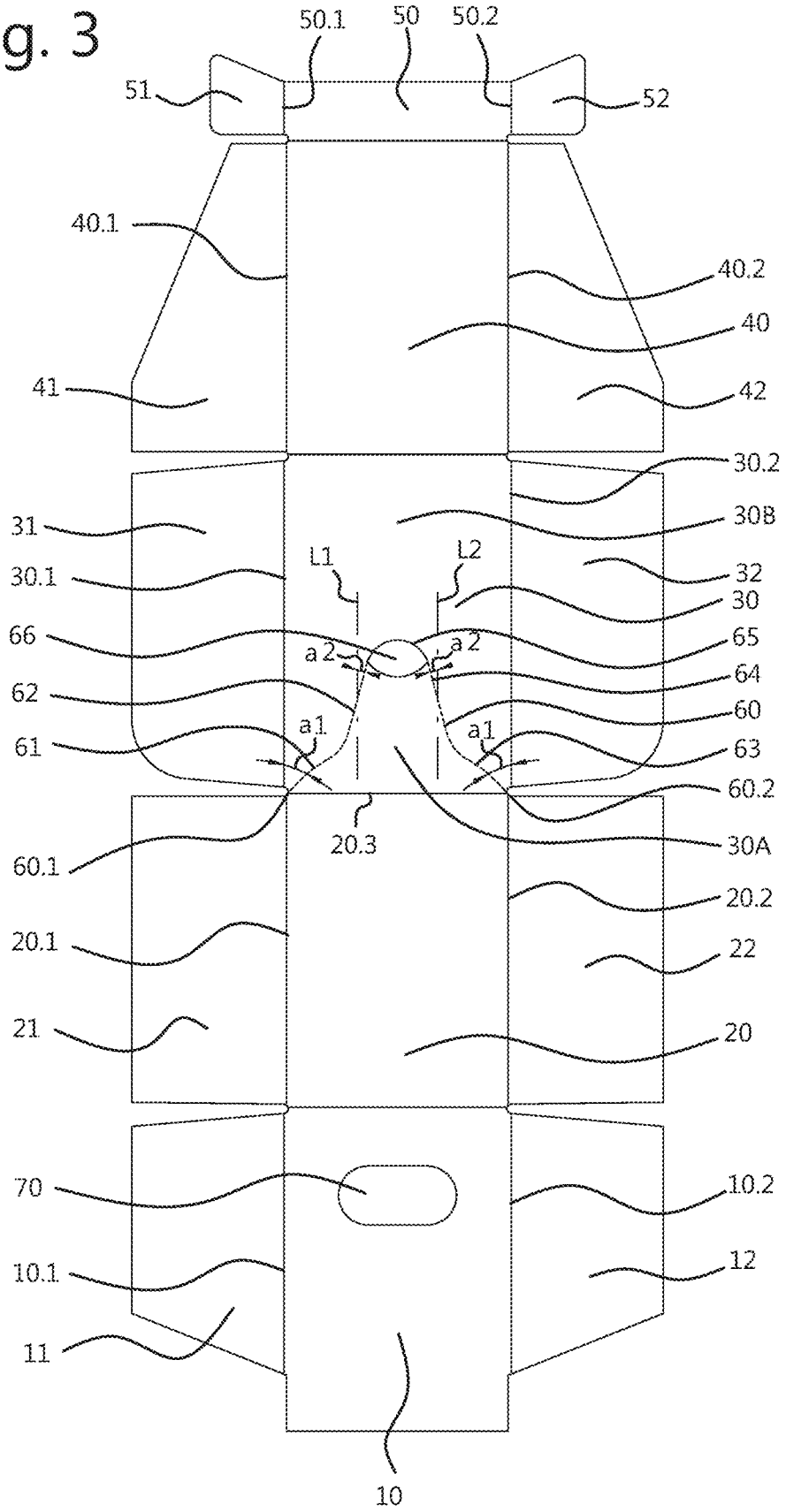
FIG. 3 shows a blank from which the packing box of FIGS. 1A, 1B and 2 is made.

An embodiment of a packing box according to the invention is shown in FIGS. 1A and 1B in a shipping (transport) configuration 1. The packing box in the shipping configuration can hold articles for shipping from one location to another. The corresponding blank from which the packing box is made is shown in FIG. 3. The packing box comprises five panels 10, 20, 30, 40, 50 that are sequentially connected to one another from a first panel 10 to a last panel 50. The panels in the shipping configuration define four sides and a circumference of the packing box. Panel 10 has a handle opening 70, and is provided on the inside of panel 50 in the assembled packing box.

The packing box further comprises flaps 11, 12, 21, 22, 31, 32, 41, 42, 51, 52 that in cooperation with one another define further sides of the packing box in the shipping configuration. The flaps are connected to the panels at opposing first and second flap side flanks 10.1, 10.2, 20.1, 20.2, 30.1, 30.2, 40.1, 40.2, 50.1, 50.2 of the panels 10, 20, 30, 40, 50. For instance, flaps 21 and 22 are connected to panel 20 at opposing flap flanks sides 20.1 and 20.2, respectively, and flaps 31 and 32 are connected to panel 30 at opposing flap flanks sides 30.1 and 30.2, respectively. Adjacent flaps that are connected to mutually connected panels are attached to one another. Flap 11 is attached to flap 21, flap 21 is attached to flap 31, flap 31 is attached to flap 41, flap 41 is attached to flap 51, flap 12 is attached to flap 22, etcetera.

Figure 2:
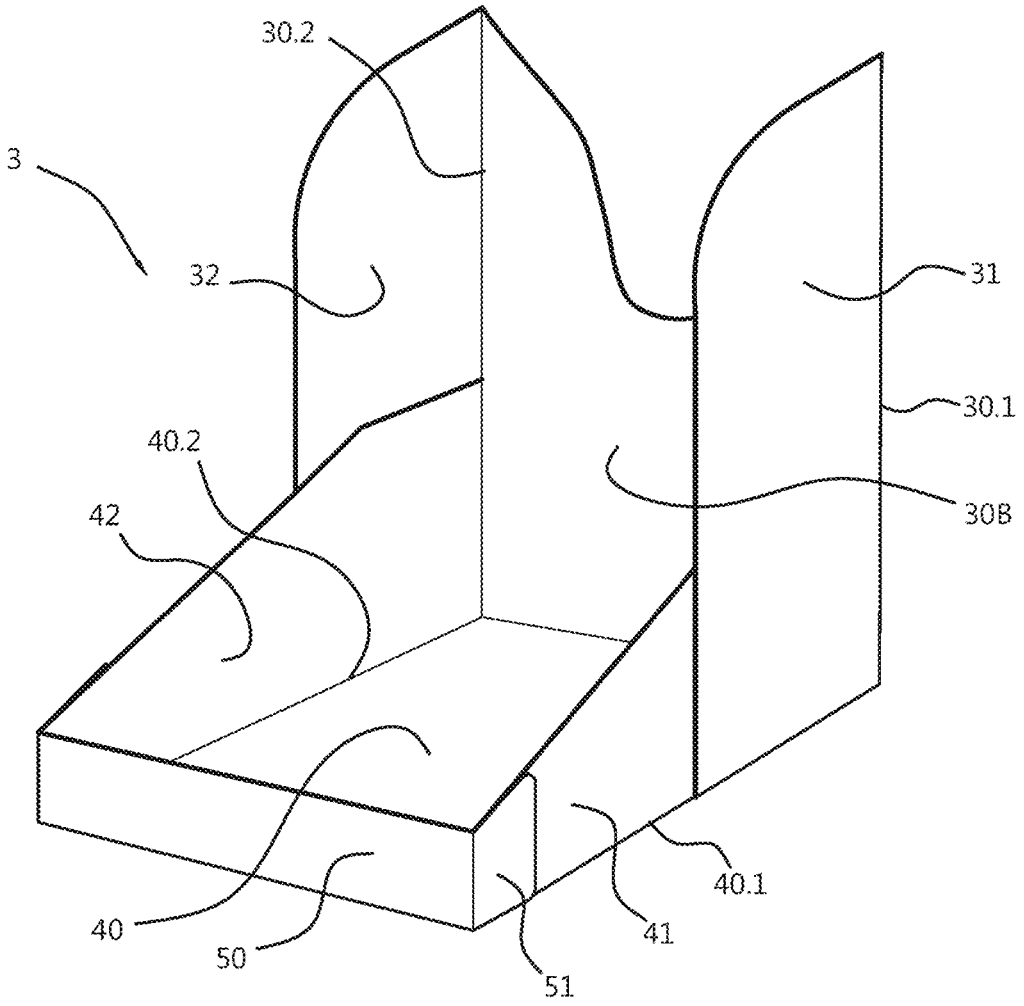
FIG. 2 shows the packing box of FIGS. 1A and 1B in the display configuration.

A separation line 60 configured as a perforation line in the embodiment shown is provided in panel 30 and extends from a first separation line end 60.1 to a second separation line end 60.2. Panel 30 is divided in panel parts 30A, 30B by the separation line 60. The separation line allows to separate a separation part 2 from the packing box in the shipping configuration 1 to leave display part 3 in a display configuration of the packing box, which is shown in FIG. 2. Articles held in the packing box can then be put up for display in the display part 3 in, for instance, a super market. The separation part 2 in the embodiment shown comprises panels 10 and 20, corresponding flaps 11, 12, 21 and 22, and panel part 30A. The display part comprises panels 50 and 40, panel part 30B and corresponding flaps 51, 52, 41, 42, 31 and 32.

The first and second separation line ends 60.1, 60.2 are each associated with a position between adjacent flaps. Associated with a position between adjacent flaps means that the separation line does not pass through a flap so that a flap is either part of the separation part or the display part. The first separation line end 60.1 is associated with a position between first separation flap 21 connected to first flap side flank 20.1 of panel 20 and first display flap 31 connected to first flap side flank 30.1 of panel 30. The second separation line end 60.2 is associated with a position between second separation flap 22 connected to second flap side flank 20.2 of panel 20 and second display flap 32 connected to second flap side flank 30.2 of panel 30. The first and second separation flaps 21 and 22 are part of, and thus associated with, the separation part 2, and the first and second display flaps 31 and 32 are part of, and thus associated with, the display part 3.

The first separation flap 21 and the first display flap 31 are attached to one another in a releasable manner, and the second separation flap 22 and the second display flap 32 are attached to one another in a releasable manner. Especially, the first and second separation flaps 21, 22, and the adjacent first and second display flaps 31, 32 are attached to one another, respectively, in a releasable manner that allows attachment release of said respective adjacent first and second separation and display flaps while maintaining integrity of the flaps and panels when the separation part 2 is separated from the packing box. This allows a separation of the separation part 2 from the display part 3 which does not damage the various panels and flaps of the packing box by releasing the releasable attachment of the respective adjacent separation and display flaps 21, 31, 22, 32 and tearing the perforated separation line 50.

In the embodiment shown in FIGS. 1A, 1B and 2 the first and second separation flaps 21, 22, and the adjacent first and second display flaps 31, 32 are attached to one another, respectively, in a releasable manner that allows attachment release of the respective adjacent first and second separation and display flaps through rotation of panel 20 that is connected to the first and second separation flaps 21, 22 with respect to the adjacent connected panel 30 that is connected to the first and second display flaps 31, 32. Panel 20 is then rotated around an intersection line 20.3 of the respective panels 20 and 30 connected to the first and second separation and display flaps. To that end the respective first and second separation and display flaps are attached to one another, respectively, by a glue allowing said respective adjacent first and second separation and display flaps to be separated with a force manually applied to the separation part. The force to be applied will be determined by the adhesive characteristics of the glue used, the amount of glue used and the surface area over which the glue is applied, which can easily be chosen such in practical circumstances that the force required to break the attachment can be manually applied. A glue that has releasable properties by itself can also be used.

Alternatively or additionally, the respective first and second separation and display flaps are attached to one another, respectively, by a glue provided to glue areas G of the respective first and second separation and display flaps. The glue areas of the first and second separation flaps of such embodiment are surrounded by a perforation line P21, P22, P31, P32 as shown for an alternative blank in FIG. 4. One or both the separation and display flaps can be provided with a perforation line around the glue areas. A releasable glue or an unreleasable glue on glue areas surrounded by a perforation line can be provided. Having both a releasable glue and perforation les around a glue area provides parallel releasable attachments, which may prove advantageous for some applications.

FIGS. 1A, 1B, 3 and 4 show the separation line 60 extending through a single panel 30 that is connected to the first and second display flaps. The separation line 60 does not coincide with the intersection line 20.3 of the panel 20 connected to the flaps 21, 22 associated with the separation part 2 and the adjacent panel 30 connected to the flaps 31, 32 associated with the display configuration 2.

The first and second separation line ends 60.1, 60.2 of the separation line of the FIGS. 1A, 1B, 2 and 3 embodiment are each in a respective corner of the panel 30 connected to the first and second display flaps 31, 32. The separation line has first sections 61, 63 at the separation line ends 60.1, 60.2 that include a first angle $\alpha 1$ of 30°-60° with a respective associated flap flank side 30.1, 30.2 (or a line parallel thereto). Preferably, the first angle $\alpha 1$ is in the range of 40°-50°. The figures show the first angle $\alpha 1$ to be approximately 45°. Second sections 62, 64 of the separation line 60 following the respective first sections 61, 63 as regarded from the separation line ends include a second angle $\alpha 2$ with a line L1, L2 parallel to the respective associated flap flank side 30.1, 30.2 which is smaller than the first angle $\alpha 1$. The middle section 65 of the separation line 60 includes an opening 66.

Figure 4:
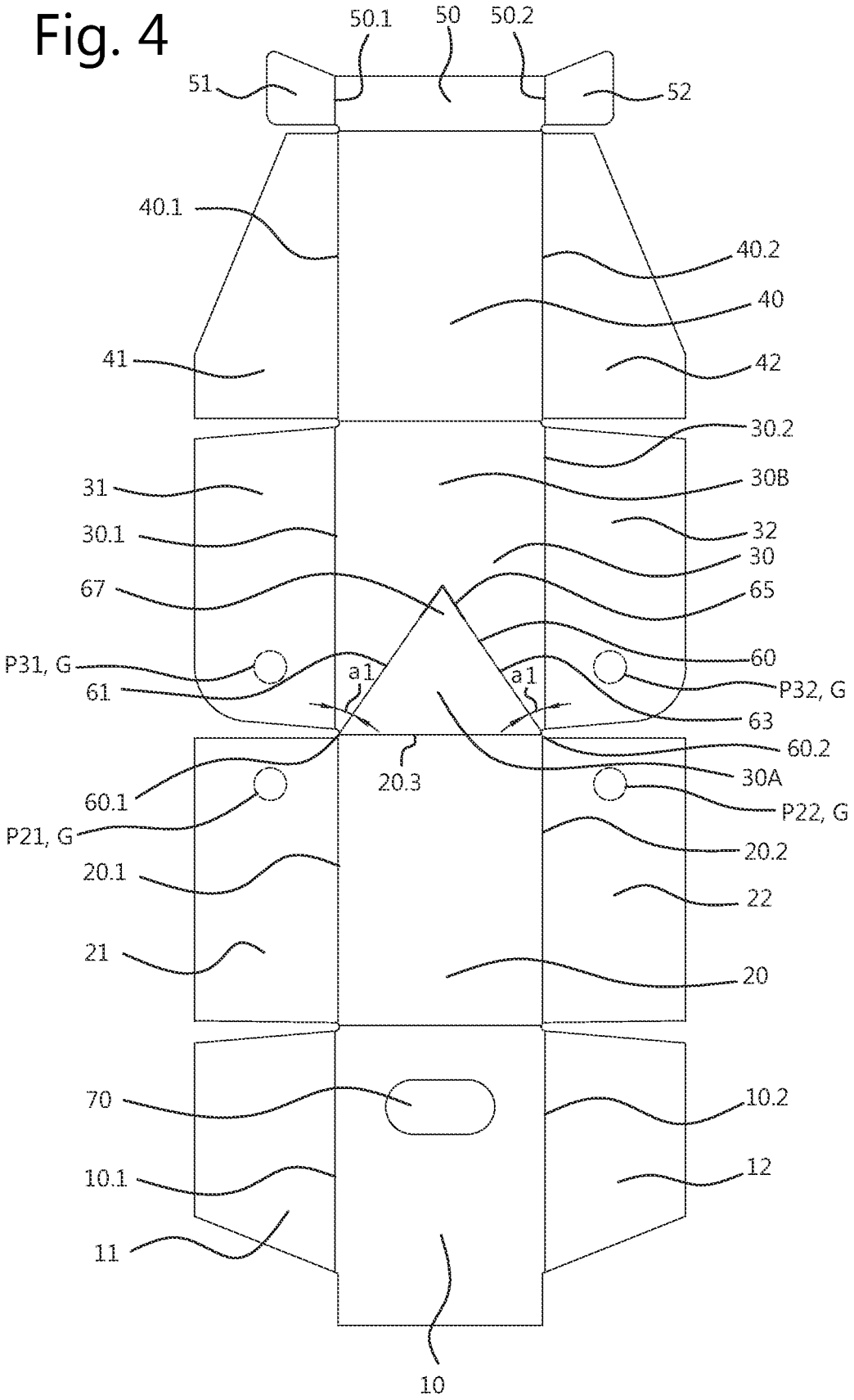
FIG. 4 shows a blank for yet another embodiment of a packing box according to the invention.

An alternative embodiment, of which a blank is shown in FIG. 4, comprises a triangular shaped separation line 60, with a fully cut-through part 67 in a middle section 65. The separation line 60 of FIG. 4 also has first sections, actually the legs of the triangle, including an angle α1 as discussed with respect to the embodiment of FIG. 3.

Figure 5A:
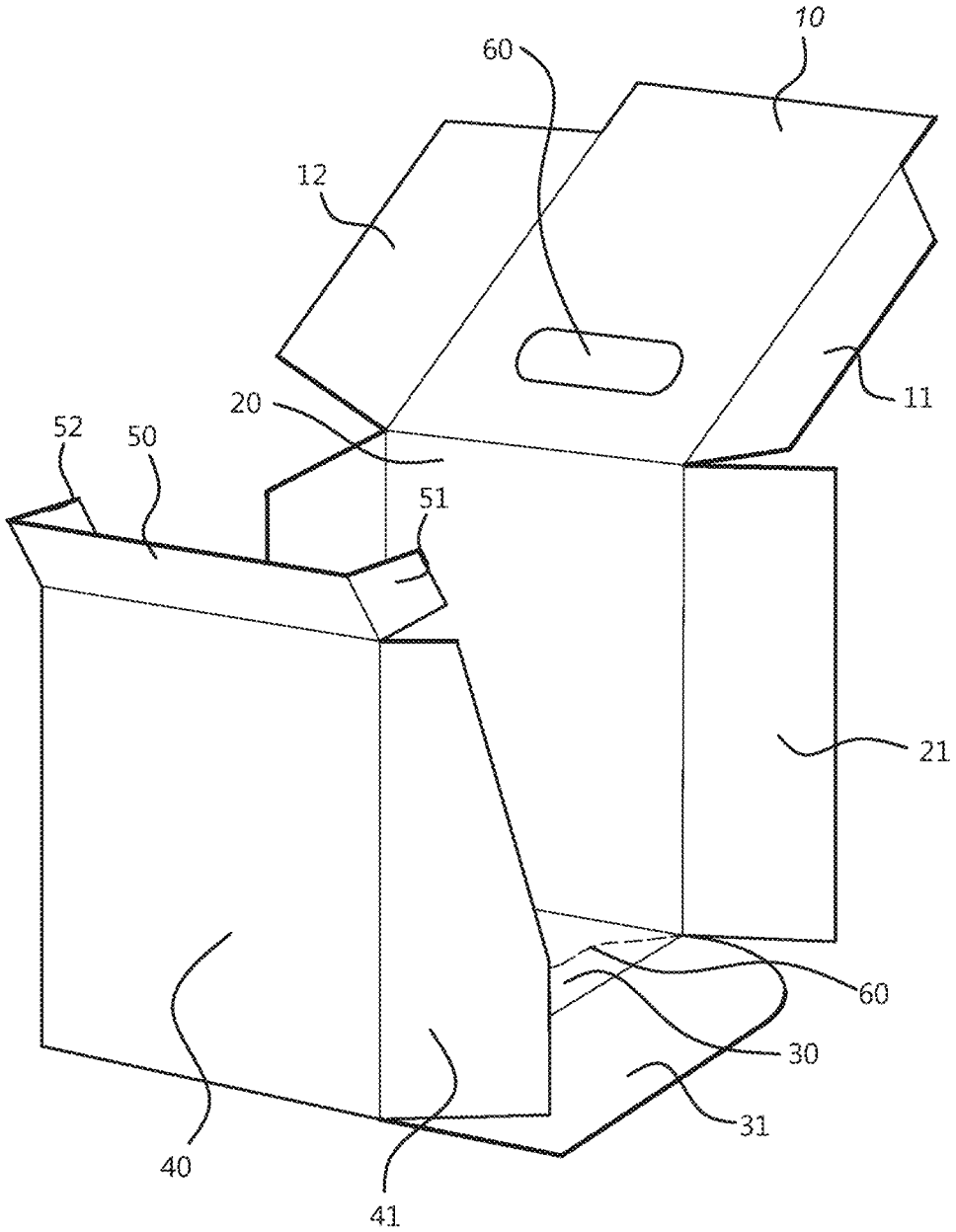
FIGS. 5A and 5B show steps in a method according to the invention for packing articles into a packing box according to the invention.

In a packing method of packing articles into the packing box a blank as shown in FIG. 3 is provided. Other blanks according to the invention may also be used, such as the blank shown in FIG. 4. The packing box is partially assembled into the shipping configuration from the blank to allow articles to be packed inside the partially assembled packing box. Panels 20, 30 and 40 are folded with respect to one another to form a U-shape, as is shown in FIG. 5A. Some respective flaps may or may not be attached to one another at this moment. According to the steps shown in FIGS. 5A and 6B, respective flaps are not yet attached to one another. Flaps 42 and 22 are shown to be already folded in place at this point to define a well-determined position for articles the be packed.

Figure 5B:
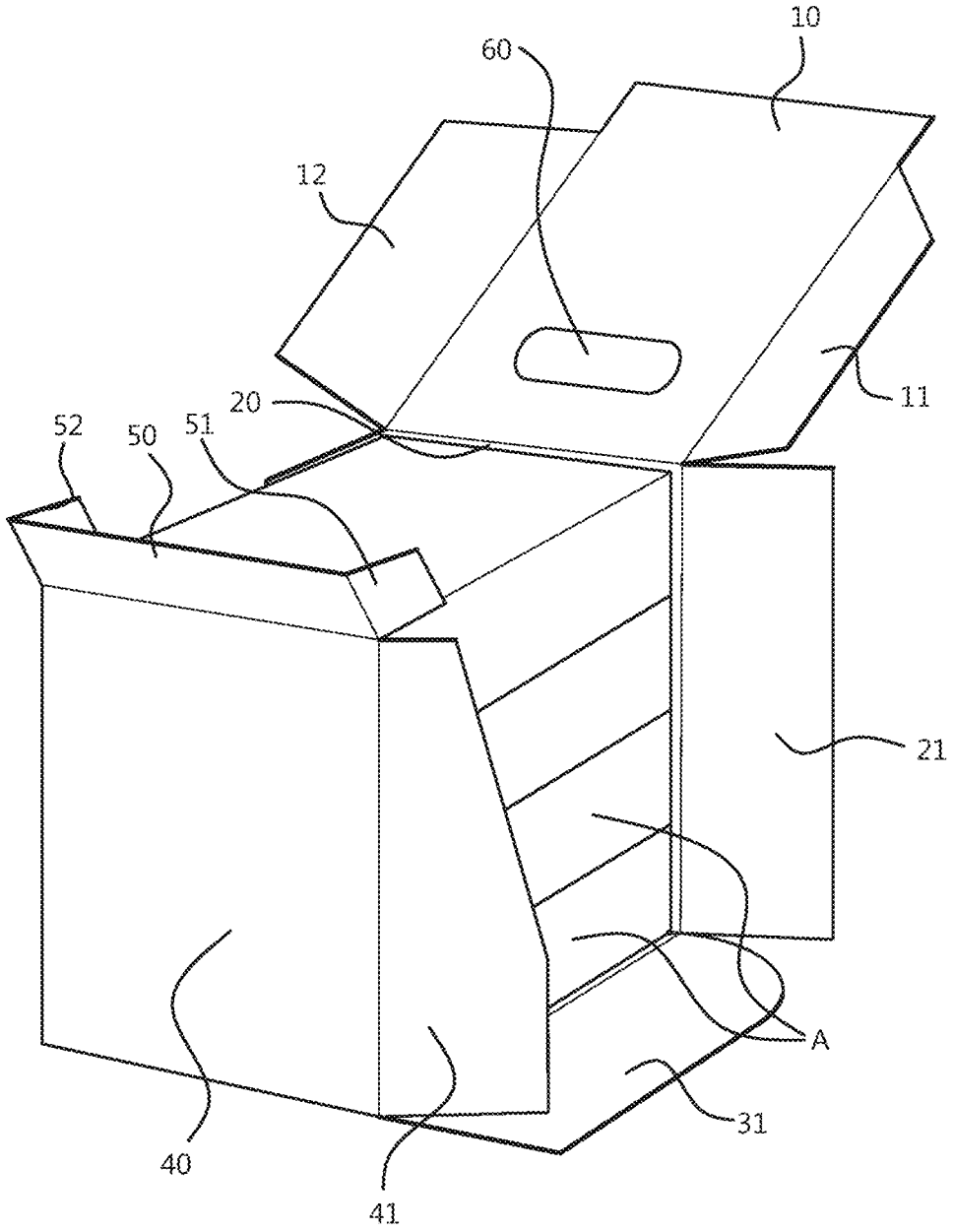

Subsequently, articles A are packed into the partially assembled shipping configuration of the packing box, as is shown in FIG. 5B. After packing the articles A, the packing box is finally assembled into the shipping configuration by subsequently folding panels 10 and 50 over the articles, folding in all (remaining) flaps, and attaching respective flaps to one another. Folding in and attachment of respective flaps may be done in various orders and on various moments in the process. This yields the packing box in the shipping configuration as shown in FIGS. 1A and 1B.

The first and second separation flaps 21, 22, and the adjacent first and second display flaps 21, 32 are attached to one another, respectively, in a releasable manner. The first and second separation flaps, and the adjacent first and second display flaps are attached to one another, respectively, in a releasable manner that allows attachment release of said respective adjacent first and second separation and display flaps while maintaining integrity of the flaps and panels. Especially, the first and second separation flaps, and the adjacent first and second display flaps are attached to one another, respectively, in a releasable manner to allow attachment release of said respective adjacent first and second separation and display flaps through rotation of the panel 20 connected to the first and second separation flaps 21, 22 with respect to the adjacent connected panel 30 connected to the first and second display flaps 31, 32 around an intersection line 20.3 of said respective panels 20, 30 connected to the first and second separation and display flaps.

In the embodiment depicted, the first and second separation flaps, and the adjacent first and second display flaps are attached to one another, respectively, by a (releasable) glue allowing said respective adjacent first and second separation and display flaps to be separated with a force manually applied to the separation part.

Alternatively or additionally, the first and second separation flaps 21, 22, and the adjacent first and second display flaps 31, 32 are attached to one another, respectively, by a glue provided to glue areas G of the first and second separation flaps and the adjacent first and second display flaps, and the glue areas of one or both of the first and second separation flaps and the adjacent first and second display flaps are surrounded by a perforation line P21, P22, P31, P32. In such embodiment a blank according to FIG. 4 is used for assembling the packing box.

Figure 6A:
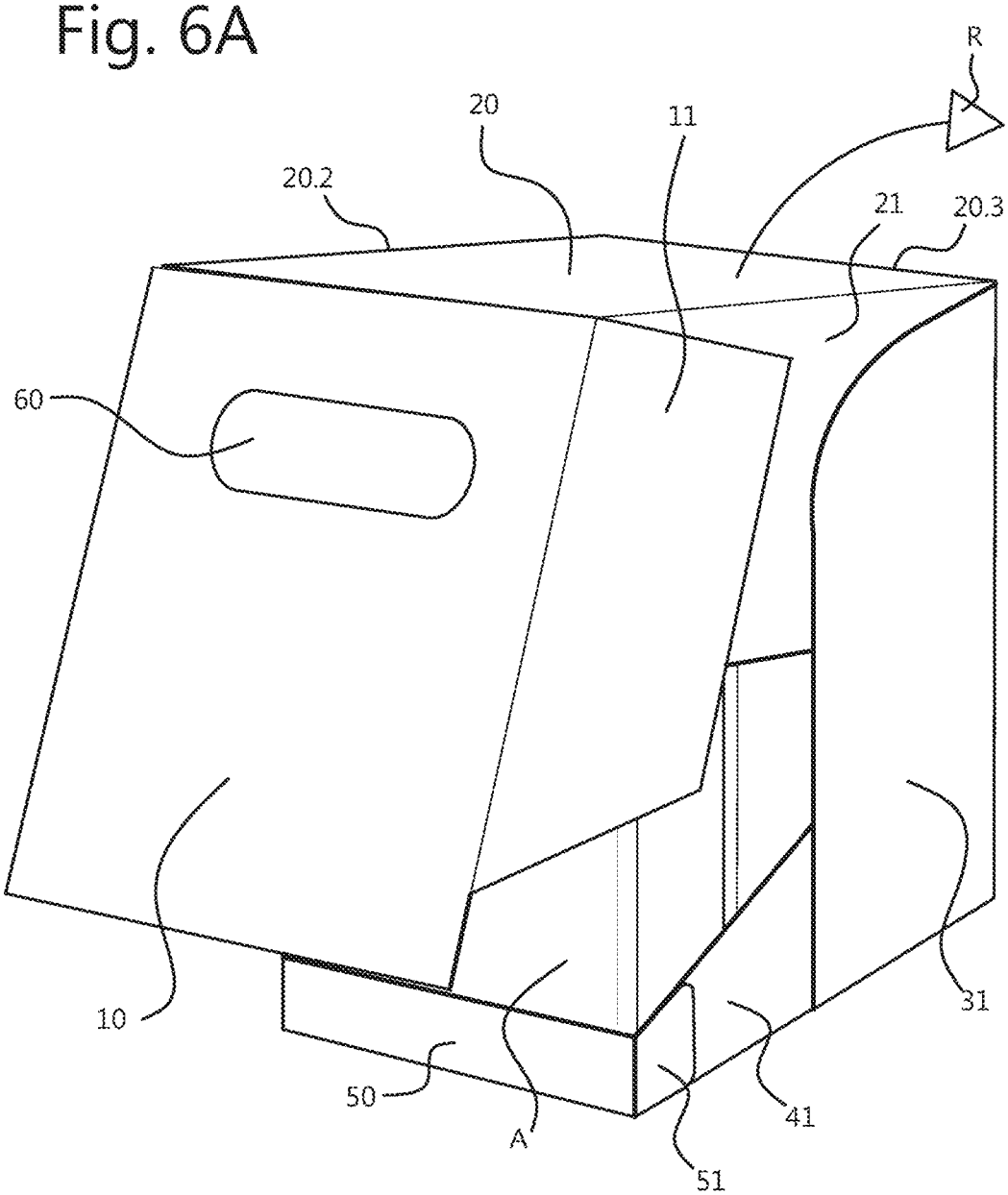
FIGS. 6A and 6B show steps in a method according to the invention for converting a packing box according to the invention from the shipping configuration to the display configuration.
Figure 6B:
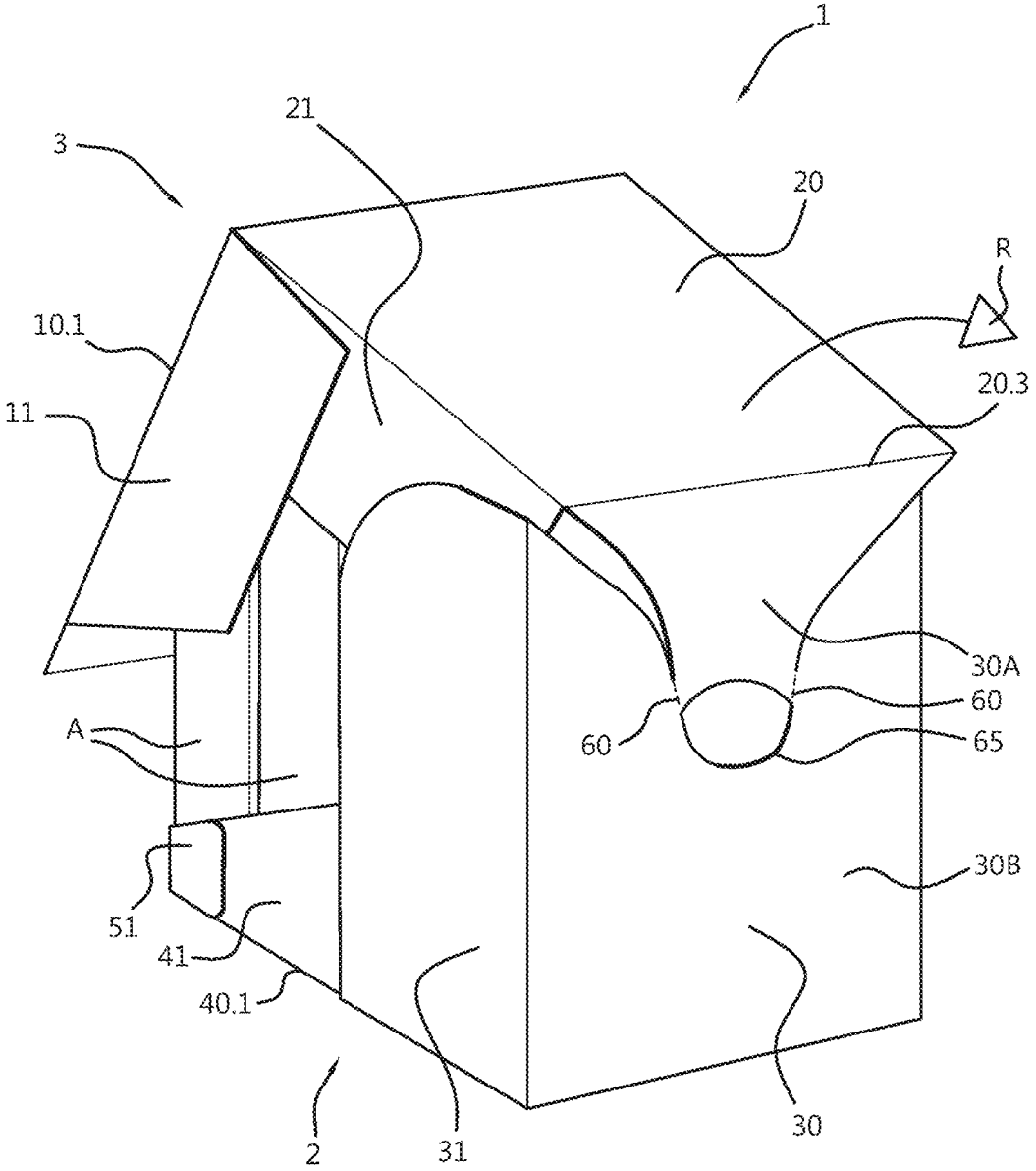

When the packing box with articles has been transported in the shipping operation to a location where the articles A are to be put up for display, for instance, in a super market, the display configuration of the packing box is provided in a display preparation method as shown in FIGS. 6A and 6B. The display preparation method comprises providing the packing box packed with articles in the shipping configuration as shown in FIGS. 1A and 1B. Subsequently, attachment of the first and second separation flaps 21, 22, and the adjacent first and second display flaps 31, 32, respectively, is released. Especially, attachment of the first and second separation flaps 21, 22, and the adjacent first and second display flaps 31, 32, respectively, is released through rotation of the panel 20 connected to the first and second separation flaps 21, 22 with respect to the adjacent connected panel 30 connected to the first and second display flaps 31, 32 around the intersection line 20.3 of said respective panels 20, 30 connected to the first and second separation and display flaps, which is shown in FIG. 6A. The rotation direction is indicated by arrow R in the figures. Thereafter, the separation part 2 is separated from the display part 3 by employing the separation line 60 to obtain the packing box in the display configuration, which is shown in FIG. 6B. Since the separation line 60 is configured as a perforated tear line, it involves tearing the separation line by further rotation and pulling of the separation part. It shows that panel part 30A is torn off from panel part 30A of panel 30. Panel part 30A is part of the separation part 2, while panel part 30B is part of the display part 3 of the packing box. FIG. 2 shows the display part with no articles A present.

The invention claimed is:

1. A packing box for shipping and displaying articles packed in the packing box, the packing box being convertible from a first configuration, called a shipping configuration in which the articles are packed and transported, to a second configuration, called a display configuration in which the articles are displayed in the packing box to customers, the packing box (1) comprising:

a single separation line (60), in the shipping configuration of the packing box, the single separation line allowing to separate a separation part (2) from the packing box in the shipping configuration to leave a display part (3) in the display configuration of the packing box;

panels (10, 20, 30, 40, 50) sequentially connected to one another from a first panel (10) to a last panel (50) to define a circumference and sides of the packing box in the shipping configuration; and flaps (11, 12, 21, 22, 31, 32, 41, 42, 51, 52) connected to the panels at respective opposing first and second flap side flanks (10.1, 10.2, 20.1, 20.2, 30.1, 30.2, 40.1, 40.2, 50.1, 50.2) of the panels, the flaps in cooperation with one another defining further sides of the packing box in the shipping configuration, and only adjacent flaps that are connected to adjacent mutually connected panels being attached to one another, wherein the single separation line (60) extends from a first separation line end (60.1) at the first flap side flank (30.1) and associated with a position between adjacent first separation and display flaps (21, 31) of the flaps, which are connected to respective first flap side flanks (20.1, 30.1), to a second separation line end (60.2) at the second flap side flank (30.2) and associated with a position between adjacent second separation and display flaps (22, 32) of the flaps, which are connected to respective second flap side flanks (20.2, 30.2), the first and second separation flaps (21, 22) being associated with the separation part (2) and the first and second display flaps (31, 32) being associated with the display part (3), and wherein the first and second separation flaps (21, 22), and the adjacent first and second display flaps (31, 32) are attached to one another, respectively, in a releasable manner, wherein the single separation line extends through a single panel (30) that is connected to the first and second display flaps (31, 32), and wherein the separation part is separable from the packing box in the shipping configuration to leave the display part in the display configuration only by releasing attachment of the first and second separation flaps and tearing the single separation line.

2. The packing box according to claim 1, wherein the first and second separation flaps, and the adjacent first and second display flaps are attached to one another, respectively, in a releasable manner that allows attachment release of said respective adjacent first and second separation and display flaps while maintaining integrity of the flaps and panels.

3. The packing box according to claim 1, wherein the first and second separation flaps, and the adjacent first and second display flaps are attached to one another, respectively, in a releasable manner to allow attachment release of said respective adjacent first and second separation and display flaps through rotation of the panel connected to the first and second separation flaps with respect to the adjacent connected panel connected to the first and second display flaps around an intersection line (20.3) of said respective panels connected to the first and second separation and display flaps.

4. The packing box according to claim 1, wherein the first and second separation flaps, and the adjacent first and second display flaps are attached to one another, respectively, by a glue, allowing said respective adjacent first and second separation and display flaps to be separated with a force manually applied to the separation part.

5. The packing box according to claim 1, wherein the first and second separation flaps, and the adjacent first and second display flaps are attached to one another, respectively, by a glue provided to glue areas (G) of the first and second separation flaps and the adjacent first and second display flaps, and the glue areas of one or both of the first and second separation flaps and the adjacent first and second display flaps are surrounded by a perforation line (P21, P22, P31, P32).

6. The packing box according to claim 1, wherein first sections (61, 63) of the single separation line (60) at the first and second separation line ends (60.1, 60.2) include a first angle (al) of 30°-60° with a respective associated flap side flank (30.1, 30.2) or a line parallel thereto.

7. The packing box according to claim 6, wherein second sections (62, 64) of the single separation line (60) following the respective first sections (61, 63) with respect to the first and second separation line ends (60.1, 60.2) and in continuation of the respective first sections include a second angle ($\alpha$2) with a line parallel to a respective associated flap side flank (30.1, 30.2) which is smaller than the first angle ($\alpha$1), and wherein the first and second angles are at corresponding sides of the respective flap side flank or line parallel thereto.

8. The packing box according to claim 6, wherein a middle section (65) of the single separation line (60) includes at least one of an opening (66) and a fully cut-through part.

9. The packing box according to claim 1, wherein the first and second separation line ends are each in a respective corner of the panel connected to the first and second display flaps.

10. The packing box according to claim 1, wherein the single separation line comprises a tear line.

11. A blank for a packing box according to claim 1, the blank comprising:

panels sequentially connected to one another from a first panel to a last panel for defining a circumference and sides of the packing box in the shipping configuration;

flaps connected to the panels at respective opposing first and second flap side flanks of the panels, the flaps in cooperation with one another allowing to define further sides of the packing box in the shipping configuration, only adjacent flaps that are connected to adjacent mutually connected panels being configured to allow attachment to one another; and a single separation line allowing to separate a separation part from the packing box in the shipping configuration to leave a display part in the display configuration of the packing box, wherein the single separation line extends from a first separation line end at the first flap side flank (30.1) and associated with a position between adjacent first separation and display flaps of the flaps, which are connected to respective first flap side flanks, to a second separation line end at the second flap side flank (30.2) and associated with a position between adjacent second separation and display flaps of the flaps, which are connected to respective second flap side flanks, the first and second separation flaps being associated with the separation part and the first and second display flaps being associated with the display part, and wherein the single separation line extends through a single panel (30) that is connected to the first and second display flaps (31, 32).

12. The blank according to claim 11, wherein first sections of the single separation line at the first and second separation line ends include a first angle of 30°-60° with a respective associated flap side flank or a line parallel thereto.

13. The blank according to claim 12, wherein second sections of the single separation line following the respective first sections with respect to the first and second separation line ends and in continuation of the respective first sections include a second angle with a line parallel to a respective associated flap side flank which is smaller than the first angle, and wherein the first and second angles are at corresponding sides of the respective flap side flank or line parallel thereto.

14. The blank according to claim 11, wherein a middle section of the single separation line includes at least one of an opening and a fully cut-through part.

15. The blank according to claim 11, wherein the first and second separation line ends are each in a respective corner of the panel connected to the first and second display flaps.

16. The blank according to claim 11, wherein glue areas of one or both of the first and second separation flaps and the adjacent first and second display flaps are surrounded by a perforation line.

17. The blank according to claim 11, wherein the single separation line comprises a tear line.

18. A packing method of packing articles into a packing box according to claim 1 in the shipping configuration, the method comprising:

providing a blank comprising panels sequentially connected to one another from a first panel to a last panel for defining a circumference and sides of the packing box in the shipping configuration of the packing box;

flaps connected to the panels at respective opposing first and second flap side flanks of the panels, the flaps in cooperation with one another allowing to define further sides of the packing box in the shipping configuration, only adjacent flaps that are connected to adjacent mutually connected panels being configured to allow attachment to one another; and a single separation line allowing to separate a separation part from the packing box in the shipping configuration to leave a display part in the display configuration of the packing box, wherein the single separation line extends through a single panel (30) from a first separation line end at the first flap side flank (30.1) and associated with a position between adjacent first separation and display flaps of the flaps, which are connected to respective first flap side flanks, to a second separation line end at the second flap side flank (30.2) and associated with a position between adjacent second separation and display flaps of the flaps, which are connected to respective second flap side flanks, the first and second separation flaps being associated with the separation part and the first and second display flaps being associated with the display part, and wherein the single panel (30) is connected to the first and second display flaps (31, 32);

partially assembling the packing box into the shipping configuration from the blank to allow articles to be packed inside the partially assembled packing box;

packing articles inside the partially assembled shipping configuration of the packing box; and finally assembling the packing box into the shipping configuration, which comprises attaching the respective flaps to one another, wherein the first and second separation flaps, and the adjacent first and second display flaps are attached to one another, respectively, in a releasable manner, and wherein only adjacent flaps that are connected to adjacent mutually connected panels are connected to one another.

19. The packing method according to claim 18, wherein the first and second separation flaps, and the adjacent first and second display flaps are attached to one another, respectively, in a releasable manner that allows attachment release of said respective adjacent first and second separation and display flaps while maintaining integrity of the flaps and panels.

20. The packing method according to claim 18, wherein the first and second separation flaps, and the adjacent first and second display flaps are attached to one another, respectively, in a releasable manner to allow attachment release of said respective adjacent first and second separation and display flaps through rotation of the panel connected to the first and second separation flaps with respect to the adjacent connected panel connected to the first and second display flaps around an intersection line of said respective panels connected to the first and second separation and display flaps.

21. The packing method according to claim 18, wherein the first and second separation flaps, and the adjacent first and second display flaps are attached to one another, respectively, by a glue, allowing said respective adjacent first and second separation and display flaps to be separated with a force manually applied to the separation part.

22. The packing method according to claim 18, wherein the first and second separation flaps, and the adjacent first and second display flaps are attached to one another, respectively, by a glue provided to glue areas of the first and second separation flaps and the adjacent first and second display flaps, and the glue areas of one or both of the first and second separation flaps and the adjacent first and second display flaps are surrounded by a perforation line.

23. A display preparation method for converting a packing box according to claim 1 from the shipping configuration to the display configuration, the method comprising:

providing a packing box packed with articles in the shipping configuration, the packing box comprising a single separation line in the shipping configuration of the packing box, the single separation line allowing to separate a separation part from the packing box to leave a display part in the display configuration of the packing box;

panels sequentially connected to one another from a first panel to a last panel to define a circumference and sides of the packing box in the shipping configuration; and flaps connected to the panels at respective opposing first and second flap side flanks of the panels, the flaps in cooperation with one another defining further sides of the packing box in the shipping configuration, and only adjacent flaps that are connected to adjacent mutually connected panels being attached to one another, wherein the single separation line extends through a single panel from a first separation line end at the first flap flank side (30.1) and associated with a position between adjacent first separation and display flaps of the flaps, which are connected to respective first flap side flanks, to a second separation line end at the second flap flank side (30.2) and associated with a position between adjacent second separation and display flaps of the flaps, which are connected to respective second flap side flanks, the first and second separation flaps being associated with the separation part and the first and second display flaps being associated with the display part, wherein the single separation line extends through a single panel (30) that is connected to the first and second display flaps (31, 32), and wherein the first and second separation flaps, and the adjacent first and second display flaps are attached to one another, respectively, in a releasable manner releasing attachment of the first and second separation flaps, and the adjacent first and second display flaps, respectively; and separating the separation part from the display part by employing the single separation line to obtain the packing box in the display configuration.

24. The display preparation method according to claim 23, wherein the method comprises releasing attachment of the first and second separation flaps, and the adjacent first and second display flaps, respectively, through rotation of the panel connected to the first and second separation flaps with respect to the adjacent connected panel connected to the first and second display flaps around an intersection line of said respective panels connected to the first and second separation and display flaps.

* * * * *